US010716394B1

(12) United States Patent
Jennings

(10) Patent No.: US 10,716,394 B1
(45) Date of Patent: Jul. 21, 2020

(54) FITTED LAP TABLE

(71) Applicant: Kathryn L. Jennings, South Bend, IN (US)

(72) Inventor: Kathryn L. Jennings, South Bend, IN (US)

( * ) Notice: Subject to any disclaimer, the term of this patent is extended or adjusted under 35 U.S.C. 154(b) by 0 days.

(21) Appl. No.: 16/193,348

(22) Filed: Nov. 16, 2018

(51) Int. Cl.

| | |
|---|---|
| ***A47B 23/00*** | (2006.01) |
| ***A47B 23/02*** | (2006.01) |
| ***A47B 3/08*** | (2006.01) |
| ***A47B 13/00*** | (2006.01) |
| ***A61G 7/075*** | (2006.01) |
| ***A47B 13/10*** | (2006.01) |

(52) U.S. Cl.
CPC ..... *A47B 23/001* (2013.01); *A47B 3/08* (2013.01); *A47B 13/003* (2013.01); *A47B 13/10* (2013.01); *A47B 23/025* (2013.01); *A61G 7/075* (2013.01)

(58) Field of Classification Search
CPC ... A47B 23/001; A47B 13/003; A47B 23/025; A47B 13/10; A47B 3/08; A47B 23/002; A47B 23/02; A61G 7/075; A47G 23/0608
See application file for complete search history.

(56) References Cited

U.S. PATENT DOCUMENTS 130,094 A * 7/1872 White et al. ..... A47B 23/002 108/43
734,757 A * 7/1903 Schuehle et al. ..... A47B 1/04 108/80
1,478,780 A * 12/1923 Akesson ..... A47C 7/68 297/149
1,709,927 A * 4/1929 Whitney ..... A47B 3/0815 108/18
2,328,471 A * 8/1943 Leffel ..... A47B 27/00 108/6
2,663,603 A * 12/1953 Newman ..... A47G 23/0608 108/43
2,758,899 A * 8/1956 Smith ..... A47B 3/0815 108/18
2,797,973 A * 7/1957 Culpepper ..... A47C 7/68 108/157.11
2,844,429 A * 7/1958 Frey ..... A47B 23/002 108/43
3,123,935 A * 3/1964 Williams ..... A47B 13/16 248/346.01
3,709,158 A * 1/1973 Kidd ..... A47B 23/001 108/43
3,915,102 A * 10/1975 Barron ..... A47B 9/14 108/146
4,512,607 A * 4/1985 Rapp ..... A47B 23/02 108/49
4,557,200 A * 12/1985 Geschwender ..... A47B 23/001 108/132
4,807,928 A * 2/1989 Cone ..... A47B 23/02 297/153
4,858,796 A * 8/1989 Roth ..... B60N 3/002 224/482

(Continued)

*Primary Examiner* — Hanh V Tran
(74) *Attorney, Agent, or Firm* — Cramer Patent & Design, PLLC; Aaron R. Cramer

(57) ABSTRACT

A lap table has a semi-circular cut-out along an inside edge of an extended platform. Beneath the table are a pair of adjustable leg assemblies that are capable of providing an upright configuration that allows the platform to stand and abut against a body of a user, particularly while lying in a bed.

4 Claims, 4 Drawing Sheets

(56) References Cited

U.S. PATENT DOCUMENTS 4,927,107 A * 5/1990 Mateo Maria ..... A47B 5/04 108/134
4,976,204 A * 12/1990 Konkle ..... A47B 23/001 108/43
5,669,312 A * 9/1997 Norton ..... A47B 23/02 108/147
6,044,758 A 4/2000 Drake
6,116,166 A 9/2000 Rotstein
6,164,218 A * 12/2000 Donalson ..... A47B 23/007 108/144.11
6,220,181 B1 * 4/2001 Horski ..... A47B 13/10 108/138
6,253,688 B1 * 7/2001 Lor ..... A47B 23/001 108/129
6,401,630 B1 * 6/2002 Peterson ..... A47B 9/16 108/115
6,561,107 B1 * 5/2003 Wood ..... A47B 3/0812 108/132
D505,803 S 6/2005 Mason
7,207,290 B2 * 4/2007 Nichols ..... A01K 5/0114 108/116
7,293,751 B2 11/2007 Eriksson
D583,164 S 12/2008 Jennings
8,205,561 B1 * 6/2012 Bierworth ..... A47C 7/70 108/9
D679,921 S 4/2013 Kiechler
8,424,464 B2 * 4/2013 Korpi ..... A47B 23/044 108/27
D720,152 S 12/2014 Chauss et al.
9,468,290 B2 * 10/2016 Roth ..... A47B 19/06
D772,596 S 11/2016 Waxman
9,510,673 B2 * 12/2016 Fountain, Jr. ..... A47B 23/002
D785,361 S 5/2017 Salisbury
9,642,452 B2 * 5/2017 Fecheyr-Lippens ..... A47B 9/06
D794,974 S 8/2017 Jennings
D799,851 S 10/2017 Waxman
2002/0033436 A1 * 3/2002 Peng ..... F16M 11/10 248/284.1
2005/0061937 A1 * 3/2005 Kim ..... F16M 11/10 248/274.1
2008/0314851 A1 * 12/2008 Jacoby ..... A47B 23/001 211/149
2008/0315049 A1 * 12/2008 Bailo ..... F16M 11/10 248/176.1
2009/0008349 A1 * 1/2009 Kim ..... G06F 1/1607 211/150
2010/0300334 A1 * 12/2010 Tcholakov ..... A47B 3/08 108/127
2011/0139039 A1 * 6/2011 Peters ..... A47B 23/002 108/42
2011/0219988 A1 * 9/2011 Stephens ..... A47B 9/00 108/6
2015/0305492 A1 * 10/2015 Fountain, Jr. ..... A47B 23/002 108/43
2016/0058177 A1 * 3/2016 Calderone ..... A47B 23/025 5/507.1
2016/0157601 A1 * 6/2016 Koulizakis ..... A47B 83/02 108/50.14
2019/0001481 A1 * 1/2019 Faibish ..... B25H 1/04

* cited by examiner

FITTED LAP TABLE

RELATED APPLICATIONS

Non-applicable.

FIELD OF THE INVENTION

The presently disclosed subject matter is directed to a fitted lap table.

BACKGROUND OF THE INVENTION

Whenever people are confined to a bed, whether it be a hospital bed or simply their bed at home, providing a means of enjoying life can be difficult. One such method of maintaining a certain quality of existence is by providing the confined individual with a tray. While seemingly insignificant, the tray provides the individual with the means of utilizing a computer, eating, reading and/or engaging in a myriad of activities that would otherwise not be able to be performed without the tray.

While hospital bed tables and trays have been known in the art for decades if not centuries, such devices are presented in a polygonal format and fail to take into account the various body shapes of modern men and women. This being the case, a lap table that is fitted to secure about the stomach region of a man or woman with a large stomach is required. The fitted lap table fulfills this need in method which is easy, safe and cost effective.

BRIEF SUMMARY OF THE INVENTION

The principles of the present invention provide for an A lap table, comprising a pair of leg assemblies on opposing sides that are independently deployable from a table. The table has a top surface and a bottom surface. Each leg assembly is capable of independently expanding relative from the table to widen or shorten. A rear side and a front side of the table have a length larger than the opposing sides. The rear side of the table has a semi-circular notch cut-out that is defined as a curvilinear portion and is bisected by a centerline rendered parallel with the opposing side edges. The curvilinear portion has different radii or positioned closer to a first side perimeter edge or a second side perimeter edge as desired.

A first leg assembly is pivotally attached to the bottom surface, the first leg assembly is subjacent a first armrest with a pair of bracket assemblies. The pair of bracket assemblies have a paired first bracket and a second bracket. A general area between the first front edge of the semi-circular portion and the first side perimeter edge is the first armrest and a general area between the second front edge of the semi-circular portion and the second side perimeter edge is a second armrest. The second leg assembly is pivotally attached to the bottom surface, subjacent the second armrest with a pair of bracket assemblies, also comprising an identical paired first bracket and a second bracket.

A pair of second opposing ends of the rear side on and the front portion is affixed to a cross-member while a pair of finials affixed to each distal end of the cross-legs of the pivot features, so as to prevent the pivot features from inadvertent removal from one or both of the brackets. Each finial has a diameter larger than that of a relative slot or a bracket valley and resides on the outside of a relative bracket.

The user is confined in a bed for an extended period of time and or may be bedridden, the user utilizes the lap table in the bed to manipulate it as close to a user midriff. The table has a generally planar unitary rectangular structure. The curvilinear portion is sized and shaped to accommodate a midriff of the user and therefore is a complete semi-circle or slightly less than the complete semi-circle.

The opposing edges of the semicircular portion at the perimeter rear edge of the table terminate prior to a relative perimeter side edge. The general areas of either the armrest is sized to comfortably enable resting of a portion of an arm of the user thereon. Each leg assembly is deployable to render the lap table between a relatively flat configuration and an upright configuration. The first leg assembly has a rear portion while the first leg assembly with a first end pivotally mounted to a rear bracket assembly and a front portion with a first end pivotally mounted to a front bracket assembly. The same is true of the second leg assembly.

The front bracket assembly for the first leg assembly may be mounted adjacent the front perimeter edge to the bottom surface under the first armrest and the rear bracket assembly for the first leg assembly may be mounted adjacent the rear perimeter edge to the bottom surface under the first armrest. Each bracket assembly includes a first bracket and a second bracket, each coaligned with each other and mounted parallel to the front and rear perimeter edges of the table. The second bracket for each the bracket assembly is mounted immediately adjacent to or aligned with a relative front edge or a rear perimeter edge of the table. The first bracket for each the bracket assembly is mounted to the bottom surface towards an inner side so as to be coaligned with the second bracket at a distance therebetween that is slightly greater than the diameter of the rear portion or the front portion of a relative leg assembly.

The first bracket has a generally oval-shaped first bracket slot located there within and positioned close to the top surface and a plurality of equidistantly-spaced second bracket valleys extend downward at an angle towards the relative side perimeter edge. The first bracket slot and first bracket valleys may be coaligned with the second bracket slot and the second bracket valleys. The equidistantly-spaced first bracket valleys extend downward at an angle towards the relative side perimeter edge and a plurality of equidistantly-spaced second bracket valleys extend downward at an angle towards the relative side perimeter edge. The second bracket has coaligned and also has a generally oval-shaped second bracket slot located therewithin and positioned close to the top surface. The first end of each rear portion of each the leg assembly has a rear pivot feature. The center leg of the rear pivot feature is coextensive with the rear portion and a cross-leg of the rear pivot feature extend within the first bracket slot and the second bracket slot travel therewithin.

The rear pivot feature resides between both the first bracket and the second bracket and travel down within a coaligned first bracket valley and second bracket valley, which coincide with a desired position of the leg assembly relative to the table.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
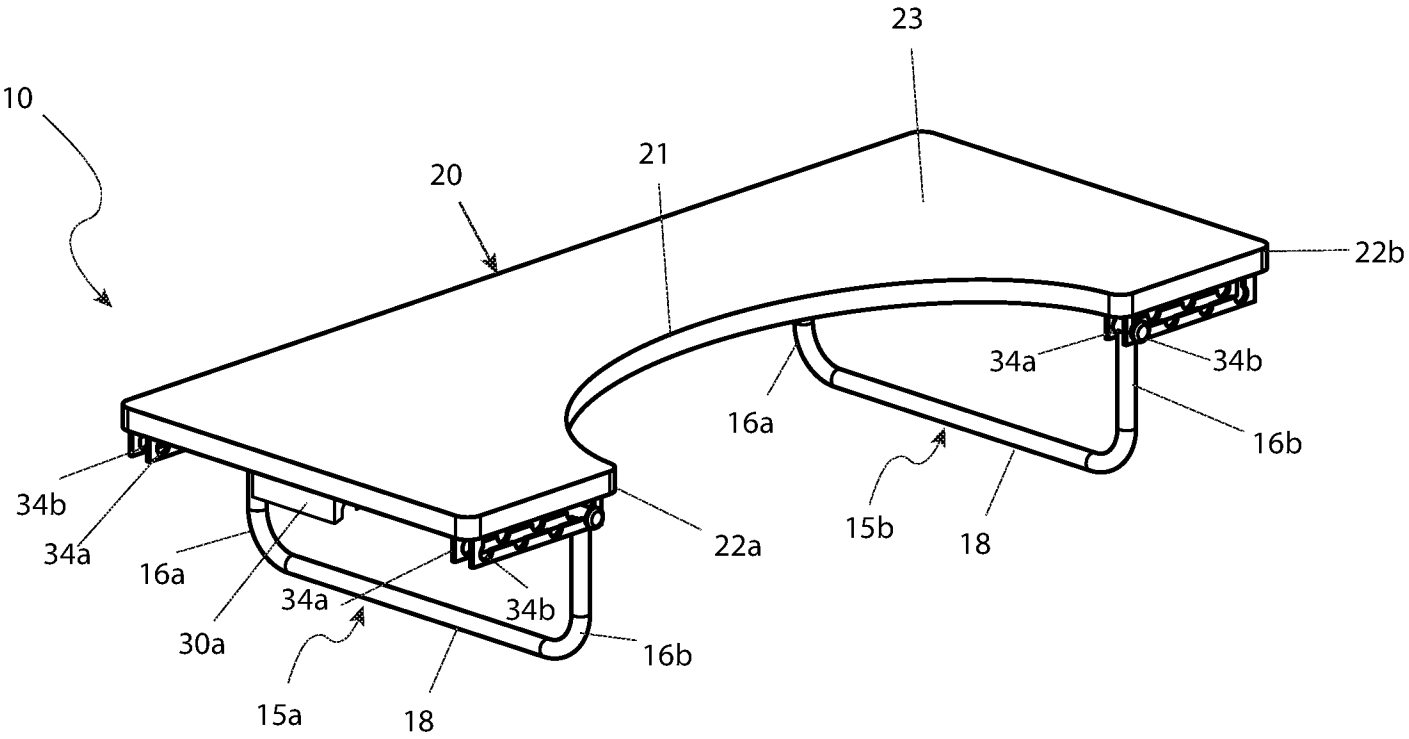
FIG. 1 is a front side perspective view of a lap table 10, according to the preferred embodiment of the present invention.
Figure 2:
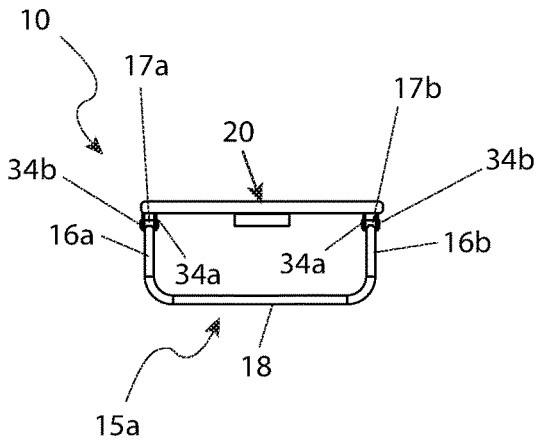
FIG. 2 is a left side elevation view of the lap table 10, according to the preferred embodiment of the present invention.
Figure 3:
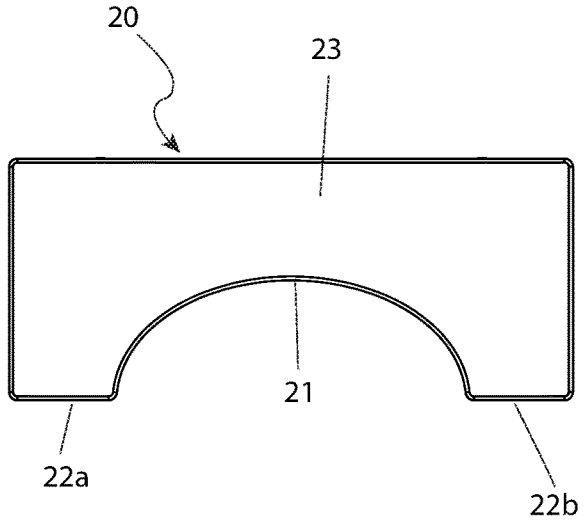
FIG. 3 is a top plan view of the lap table 10, according to the preferred embodiment of the present invention.
Figure 4:
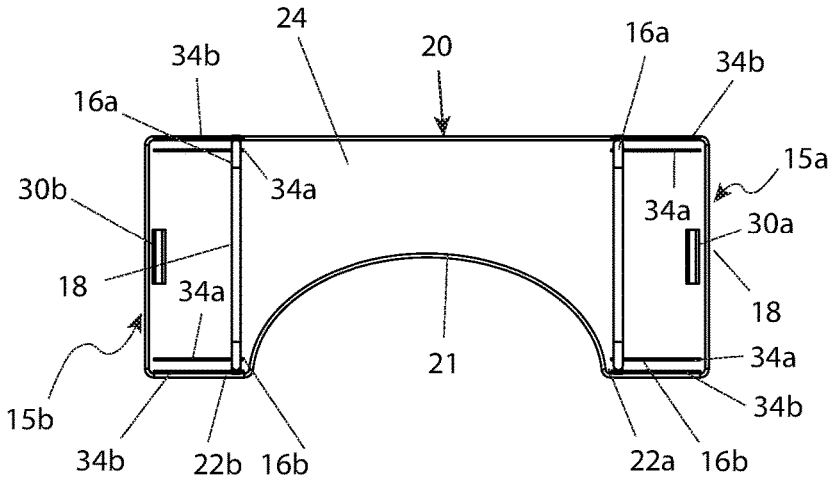
FIG. 4 is a bottom plan view of the lap table 10, according to the preferred embodiment of the present invention.

10 lap table
15*a* first leg assembly
15*b* second leg assembly
16*a* rear portion
16*b* front portion
17*a* rear pivot feature
17*b* front pivot feature
17*c* finial
18 cross-member
20 table
21 curvilinear portion
22*a* first armrest
22*b* second armrest
23 top surface
24 bottom surface
30*a* first catch
30*b* second catch
34*a* first bracket
34*b* second bracket
35*a* first bracket valley
35*b* second bracket valley
35*c* first bracket slot
35*d* second bracket slot
100 user
101 user midriff
110 bed

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Figure 6:
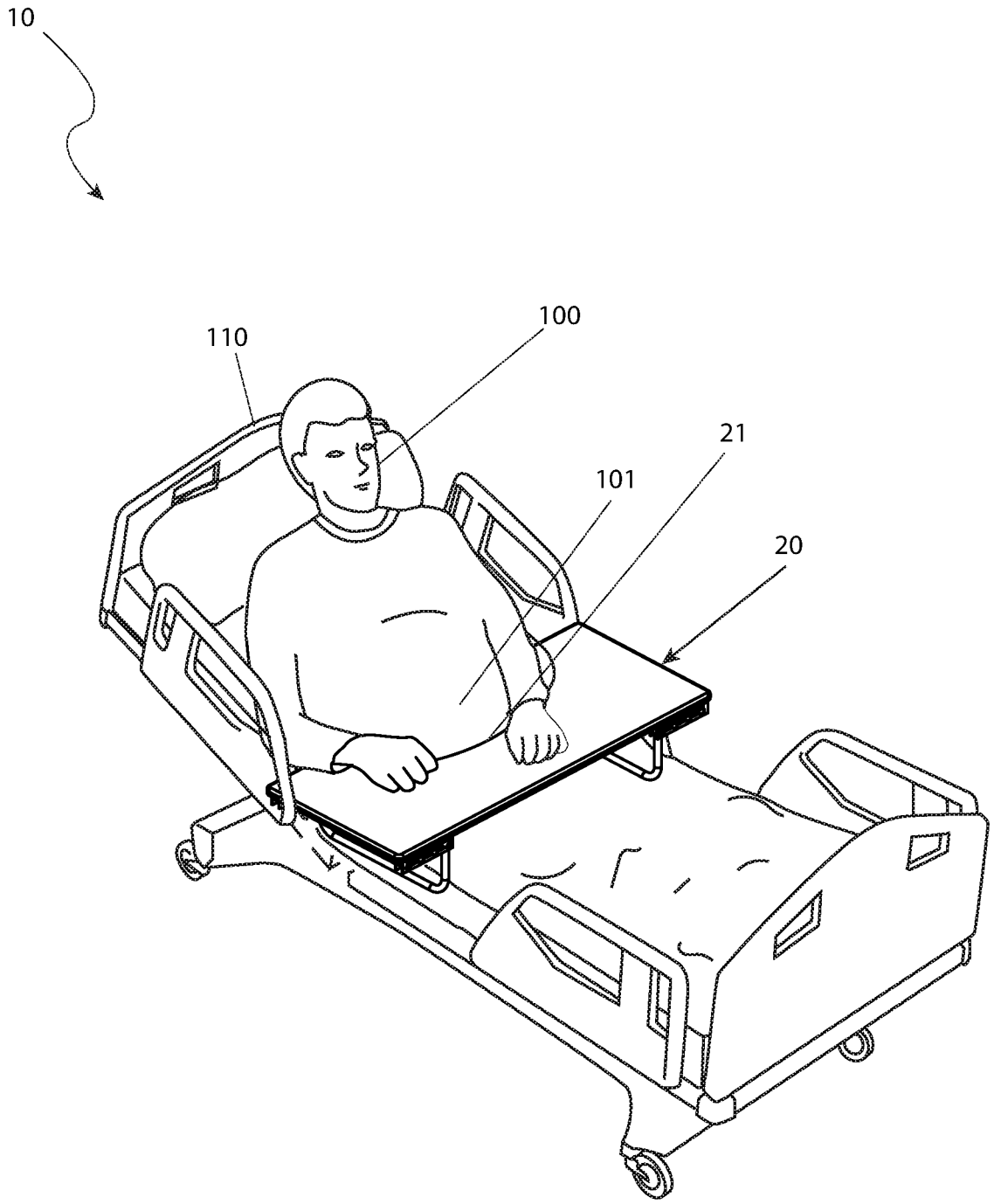

The present invention relates to a lap table 10 that is able to be quickly unfolded from a relatively flat configuration to an upright configuration. The lap table 10 generally comprises a pair of leg assemblies 15*a*, 15*b* on opposing sides that are independently deployable from a table 20. Each leg assembly 15*a*, 15*b* is also capable of independently expanding relative from the table 20 to widen or shorten as necessary. FIG. 6 illustrates an expected, but not limited to, method of use of the lap table 10. A user 100 who is confined in a bed 110 for an extended period of time, such as a bedridden patient, can utilize the lap table 10 in the bed 110 to manipulate it as close to the user midriff 101 as possible, for comfort and to restrict any items from falling from the user 100 into the bed 110, such as food.

Referring now to FIGS. 1-5, various views of the features of the lap table 10, are disclosed. As is shown, the table 20 is generally planar unitary rectangular structure and has a top surface 23 and a bottom surface 24. The rear side and front side have a length larger than the opposing sides. The perimeter edges of the table 20 have smooth, rounded corners to limit or restrict any unwanted snagging or poking of a user 100 or material. The rear side of the table 20 has a semi-circular notch cut-out that is defined as a curvilinear portion 21 and is bisected by a centerline rendered parallel with the opposing side edges. Therefore, the table 20 is symmetrical along the said centerline. The curvilinear portion 21 is sized and shaped to accommodate a midriff 101 of a user 100, and therefore may be a complete semi-circle, or slightly less than that a complete semi-circle. The curvilinear portion 21 may also have different radii or positioned closer to the first or second side perimeter edge as desired. The opposing edges of the semicircular portion 21 at the perimeter rear edge of the table 20 terminate prior to the relative perimeter side edge. The general area between the first front edge of the semi-circular portion 21 and the first side perimeter edge (herein illustrated as the left side in FIG. 1), is defined as the first armrest 22*a*. The general area between the second front edge of the semi-circular portion 21 and the second side perimeter edge (herein illustrated as the right side in FIG. 1), is defined as the second armrest 22*b*. The areas of either armrest 22*a*, 22*b*, are sized to comfortably enable resting of a portion of an arm of the user 100 thereon.

A first leg assembly 15*a* is pivotally attached to the bottom surface 24, subjacent the first armrest 25*a* with a pair of bracket assemblies, comprising a paired first bracket 34*a* and second bracket 34*b*. A second leg assembly 15*b* is pivotally attached to the bottom surface 24, subjacent the second armrest 25*a* with a pair of bracket assemblies, also comprising an identical paired first bracket 34*a* and second bracket 34*b*. Each leg assembly 15*a*, 15*b*, is deployable to render the lap table 10 between the relatively flat configuration and the upright configuration. The first leg assembly 15*a* has a rear portion 16*a*, with a first end pivotally mounted to a rear bracket assembly and a front portion 16*b* with a first end pivotally mounted to a front bracket assembly. The second opposing ends of the rear portion 16*a* and front portion 16*b* is affixed to a cross-member 18. Similarly, the second leg assembly 15*b* has a rear portion 16*a*, with a first end pivotally mounted to a rear bracket assembly and a front portion 16*b* with a first end pivotally mounted to a front bracket assembly. The second opposing ends of the rear portion 16*a* and front portion 16*b* is affixed to a cross-member 18. As such, both leg assemblies 15*a*, 15*b* have a general shape of a "U". The leg assemblies 15*a*, 15*b* can be solid or tubular, either square or cylindrical in shape.

Figure 5:
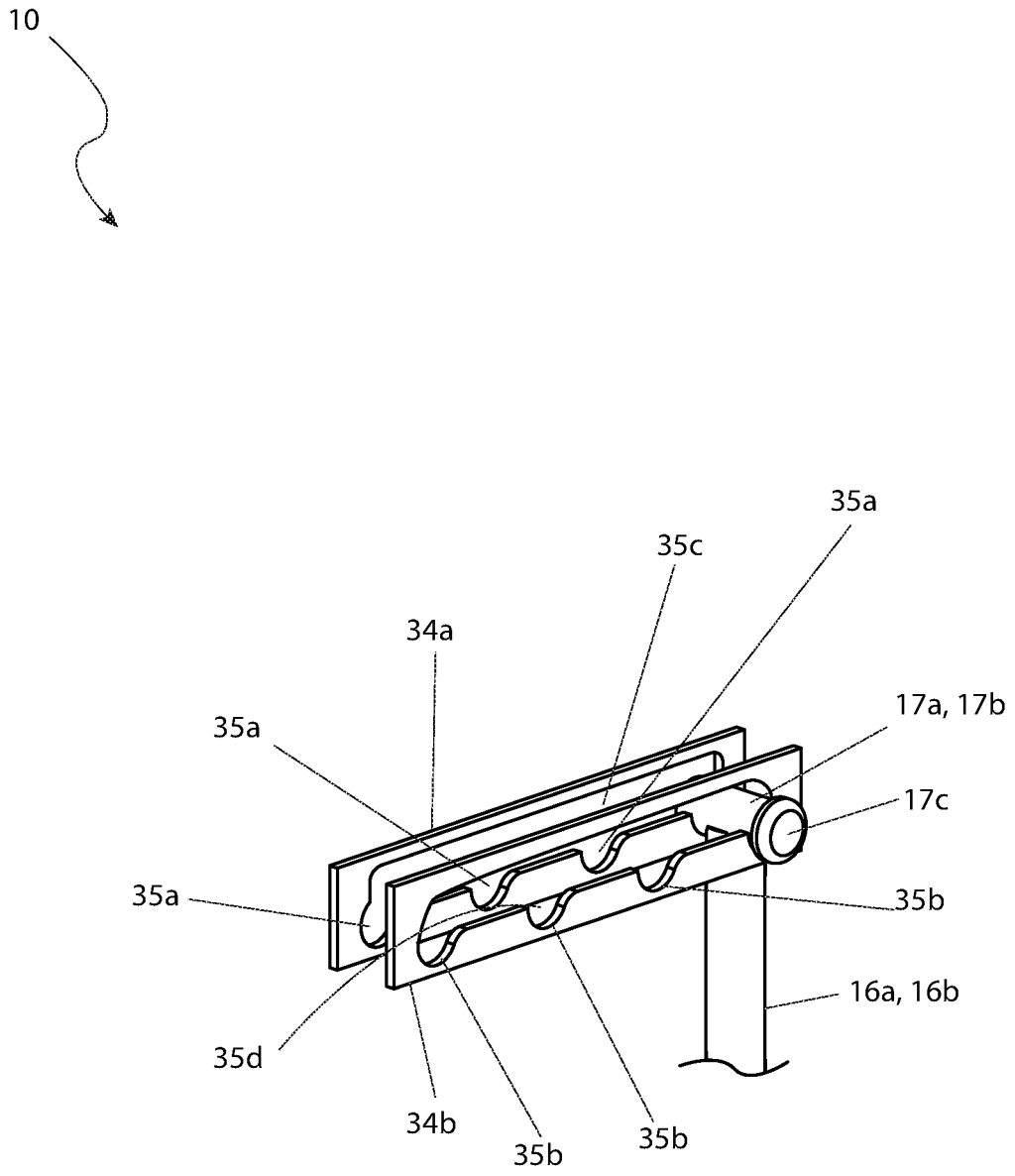
FIG. 5 is a close-up view of the first bracket 34*a* and second bracket 34*b*, according to the preferred embodiment of the present invention; and, FIG. 6 is an environmental view of the lap table 10 in a method of use, according to the preferred embodiment of the present invention.

Referring now more closely to FIG. 5, which illustrates the pivoting attachment for each leg assembly 15*a*, 15*b* to the table 20 with the bracket assembly. The front bracket assembly for the first leg assembly 34*a* is mounted adjacent the front perimeter edge to the bottom surface 24 under the first armrest 22*a* and the rear bracket assembly for the first leg assembly 34*a* is mounted adjacent the rear perimeter edge to the bottom surface 24 under the first armrest 22*a*. Similarly, the front bracket assembly for the second leg assembly 34*b* is mounted adjacent the front perimeter edge to the bottom surface 24 under the second armrest 22*b* and the rear bracket assembly for the second leg assembly 34*b* is mounted adjacent the rear perimeter edge to the bottom surface 24 under the second armrest 22*b*. For each bracket assembly, there is a first bracket 34*a*, and a second bracket 34*b*, each coaligned with each other and mounted parallel to the front and rear perimeter edges of the table 20.

The second bracket 34*b* for each bracket assembly is mounted immediately adjacent to or aligned with the relative front or rear perimeter edge of the table 20, and the first bracket 34*a* for each bracket assembly is mounted to the bottom surface 24 towards the inner side so as to be coaligned with the second bracket 34*b* at a distance therebetween that is slightly greater than the diameter of the rear portion 16*a* or front portion 16*b* of the relative leg assembly 15*a*, 15*b*. The first bracket 34*a* has a generally oval-shaped first bracket slot 35*c* located therewithin and positioned close to the top. A plurality of equidistantly-spaced first bracket valleys 35*a* extend downward at an angle towards the relative side perimeter edge. The second bracket 34*b* has coaligned also has a generally oval-shaped second bracket slot 35*d* located therewithin and positioned close to the top. A plurality of equidistantly-spaced second bracket valleys 35*b* extend downward at an angle towards the relative side perimeter edge. The first bracket slot 35*c* and first bracket valleys 35*a* are coaligned with the second bracket slot 35*d* and second bracket valleys 35*b*.

The first end of each rear portion 16*a* of each leg assembly 15*a*, 15*b* has a rear pivot feature 17*a*, that is generally shaped as a "T". The center leg of the rear pivot feature 17*a* is coextensive with the rear portion 16*a* and the cross-legs of the rear pivot feature 17*a* extend within the first bracket slot 35*c* and second bracket slot 35*d* and are capable of travel therewithin. The rear pivot feature 17*a* thusly resides between both the first bracket 34*a* and second bracket 34*b*. The rear pivot feature 17*a* can travel down within the desired coaligned first bracket valley 35*a* and second bracket valley 35*b*, which coincide with a desired position of the leg assembly 15*a*, 15*b* relative to the table 20. In a similar fashion, the first end of each front portion 16*b* of each leg assembly 15*a*, 15*b* has a front pivot feature 17*b*, that is generally shaped as a "T". The center leg of the front pivot feature 17*b* is coextensive with the front portion 16*b* and the cross-legs of the front pivot feature 17*b* extend within the first bracket slot 35*c* and second bracket slot 35*d* and are capable of travel therewithin. The front pivot feature 17*b* thusly resides between both the first bracket 34*a* and second bracket 34*b*. The front pivot feature 17*b* can travel down within the desired coaligned first bracket valley 35*a* and second bracket valley 35*b*, which coincide with a desired position of the leg assembly 15*a*, 15*b* relative to the table 20. Coincidental travel of the rear leg portion 16*a* and front leg portion 16*b* of a particular leg assembly 15*a*, 15*b* laterally positions said leg assembly 15*a*, 1*b* inward or outward from the bisecting centerline of the table 20 towards or away from the relative side perimeter edge.

A pair of finials 17*c* are affixed to each distal end of the cross-legs of the pivot features 17*a*, 17*b*, so as to prevent the pivot features 17*a*, 17*b* from inadvertent removal from one (1) or both of the brackets 34*a*, 34*b*. Each finial 17*c* has a diameter larger than that of the relative slot 35*c*, 35*d* or bracket valley 35*a*, 35*b* and resides on the outside of the relative bracket 34*a*, 34*b*.

In certain embodiments, there are means to retian the leg assemblies 15*a*, 15*b* in the stored configuration. A first catch 30*a* is mounted adjacent to the first side perimeter edge of the bottom surface 24 (herein illustrated as the left side in FIG. 1) and is capable of retaining a portion of the cross member 18 of the first leg assembly 12*a*. A second catch 30*b* is mounted adjacent to the second perimeter edge of the bottom surface 24 and is capable of retaining a portion of the cross member 18 of the second leg assembly 12*a*. The catches 30*a*, 30*b* are preferably located at a center point between the rear and front perimeter edges. The catches 30*a*, 30*b* are an elongated feature with an open curvilinear portion facing downward, having a diameter sized to permit frictional retention of the cross-member 18. Generally, each catch 30*a*, 30*b* has a "C"-shaped cross-section and is deformable enough to permit minimal forcing of the cross-member 18 thereinto yet retain the cross-member 18 therein once seated.

The table 20 is preferably fabricated out of wood with a decorative and protective finish, laminated material, plastic, to withstand spills and minor abrasions from chemicals or environmental use from marring the surface. The leg assemblies 15*a*, 15*b* may be fabricated out of plastic or aluminum material that is lightweight and resilient. The leg assemblies 15*a*, 15*b* can be fabricated in a unitary construction, such that the transitions between the cross-member 18, rear portion 16*a*, and front portion 16*b* does not have a seam, or fabricated in segments and fastened to each other. The transitions between the between the cross-member 18, rear portion 16*a*, and front portion 16*b* can be curvilinear so as to prevent unwanted snagging or damage to the user 100 or material.

Certain embodiments can provide for an overall width of the table 20 to be twenty-four inches (24 in.) and the overall length to be approximately eighteen inches (18 in.). When the leg assemblies 15*a*, 15*b* are fully deployed, the overall height is approximately eight to twelve inches (8-12 in.).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A lap table, comprising:

a table having a top surface, a bottom surface, a rear side, a front side, and a plurality of perimeter edges;

a first leg assembly and a second leg assembly, said first leg assembly and said second leg assembly are on opposing sides of said table, said first leg assembly is pivotally attached to said bottom surface of said table, said first leg assembly is subjacent a first armrest, having a paired first bracket and a second bracket, said second leg assembly is pivotally attached to said bottom surface of said table, said second leg assembly is subjacent a second armrest having a paired first bracket and a second bracket, each said leg assembly expands to widen or shorten said table;

a curvilinear portion of said table disposed on said rear side of said table, said curvilinear portion is sized and shaped to accommodate a person's midriff while said person is in a bed to provide comfort and to restrict one or more items from falling from said person into said bed, said first armrest is between a first front edge of said curvilinear portion and a first side perimeter edge said second armrest is between a second front edge of said curvilinear portion and a second side perimeter edge;

a cross-member affixed to each of a pair of second opposing ends of said rear side of said table and said front portion of said table;

an oval-shaped first horizontal bracket slot located within said first brackets;

a plurality of equidistantly spaced first horizontal bracket valleys extend downward at an angle towards a first side perimeter edge of said table;

an oval-shaped second horizontal bracket slot located within said second brackets;

a plurality of equidistantly spaced second horizontal bracket valleys extend downward at an angle towards a second side perimeter edge of said table, said first bracket slot and said first horizontal bracket valleys are coaligned with said second horizontal bracket slot and second horizontal bracket valleys; and a pair of finials each residing outside of said first leg assembly and said second leg assembly, said pair of finials having a diameter larger than said corresponding bracket slots and said bracket valleys to prevent inadvertent removal from said brackets.

2. The lap table according to claim 1, wherein said person is a bedridden patient.

3. The lap table according to claim 1, wherein said table has a planar unitary rectangular structure.

4. The lap table according to claim 1, wherein said each leg assembly is deployable to render said lap table between a flat configuration and an upright configuration.

* * * * *